US005273268A

United States Patent [19]

Ogata

[11] Patent Number: 5,273,268

[45] Date of Patent: Dec. 28, 1993

[54] SHEET MEMBER GRASPING DEVICE FOR SUPPLY APPARATUS

[75] Inventor: Masayuki Ogata, Tokyo, Japan

[73] Assignee: Bridgestone Corporation, Tokyo, Japan

[21] Appl. No.: 911,576

[22] Filed: Jul. 10, 1992

[30] Foreign Application Priority Data

Jul. 19, 1991 [JP] Japan ..... 3-203329

[51] Int. Cl.[5] ..... B65H 3/22

[52] U.S. Cl. ..... 271/18.3; 271/267

[58] Field of Search ..... 271/18.3, 14, 267

[56] References Cited

U.S. PATENT DOCUMENTS

| | | | |
|---|---|---|---|
| 3,981,495 | 9/1976 | Bijttebier | 271/18.3 |
| 4,635,917 | 1/1987 | Granot | 271/18.3 X |
| 4,805,949 | 2/1989 | Conway | 271/18.3 X |
| 5,087,315 | 2/1992 | King | 271/18.3 |

FOREIGN PATENT DOCUMENTS

| | | |
|---|---|---|
| 59-4555 | 1/1984 | Japan . |
| 63-90635 | 6/1988 | Japan . |

*Primary Examiner*—Richard A. Schacher

*Attorney, Agent, or Firm*—Sughrue, Mion, Zinn, Macpeak & Seas

[57] ABSTRACT

A device for grasping a sheet member includes a support unit, a pair of grasping units having sharp pawls, respectively, and supported by the support unit rotatably about parallel pivot axes, respectively, and a pivotally rotating unit for rotating the grasping units to move the pawls away from each other to bite the sheet member, thereby grasping the sheet member. The device is supported by a movable base through a universal joint to an apparatus for supplying the sheet member from a pallet to a conveyor. The apparatus includes a transfer unit for transferring the grasping device grasping the sheet member, a guide roller extending in the width direction of the sheet member and capable of contacting the lower surface of the sheet member, a moving unit for moving the guide roller contacting the lower surface of the sheet member from the proximity of the conveyor to a position directly above the pallet, and at least one urging roller for urging the sheet member transferred by the transfer unit against the conveyor.

15 Claims, 4 Drawing Sheets

SHEET MEMBER GRASPING DEVICE FOR SUPPLY APPARATUS

BACKGROUND OF THE INVENTION

This invention relates to a device for grasping a sheet member such as a rubber sheet or the like, and more particularly to an apparatus for supplying the sheet member grasped by the device from a pallet to a conveyor.

A device for grasping a sheet member has been known, as disclosed in, for example, Japanese Utility Model Application Laid-open No. 63-90,635. The device of the prior art includes a pair of L-shaped arms having pawls at their front ends, support members pivotally supporting the L-shaped arms at their centers to be opposed to each other, and driving means for moving the arms toward and away from each other. In grasping a sheet member, the pawls are urged against the sheet member, and in this state the arms are then pivotally rotated by the driving means so as to move the pawls toward each other, thereby embracing and biting the sheet member by the pawls to grasp the sheet member.

With such a grasping device of the prior art, the arms are pivotally rotated to move the pawls toward each other for grasping a sheet member. The portion of the sheet member between the pawls is likely to be moved by the pawls to be buckled and folded on itself. As a result, it becomes often difficult for the pawls to bite the sheet member, with consequent incomplete grasping of the sheet member.

SUMMARY OF THE INVENTION

It is an object of the invention to provide an improved device for grasping a sheet member, which is capable of easily causing pawls to bite the sheet member to grasp it in a reliable manner.

In order to accomplish this object, the device for grasping a sheet member according to the invention comprises support means, a pair of grasping units having sharp pawls, respectively, and supported by the support means rotatably about parallel pivot axes, respectively, and pivotally rotating means for rotating the grasping units to move the pawls away from each other, thereby grasping the sheet member by rotating the grasping units by the pivotally rotating means to cause the pawls to bite the sheet member.

In grasping a sheet member by means of the grasping device, first the pawls of the grasping units are brought into contact with the sheet member and in this state the grasping units are then rotated by the pivotally rotating means to move the pawls away from each other. At the moment when the pawls are moved away from each other and while they are biting the sheet member, the portion of the sheet member between the pawls is pulled by the pawls to be subjected to a tensile force. The tensile force acts in the direction causing the pawls to bite the sheet member further. Consequently, the pawls easily and securely bite the sheet member to grasp the sheet member with a great certainty.

In another aspect of the invention, the apparatus for supplying a sheet member folded on itself on a pallet to a conveyor, comprises a movable base, a grasping device supported by the movable base through a universal joint for grasping the sheet member, transfer means for transferring the movable base and the grasping device grasping the sheet member from a position above the pallet to a position above the conveyor, a guide roller extending in the width direction of the sheet member and capable of contacting the lower surface of the sheet member, moving means for moving the guide roller contacting the lower surface of the sheet member from the proximity of the conveyor to a position directly above the pallet, and at least one urging roller for urging the sheet member transferred by the transfer means against the conveyor.

In supplying a sheet member grasped by the grasping device according to the invention, first the movable base and the grasping device are transferred by the transfer means to a position immediately above the sheet member arranged on the pallet. The grasping device is then actuated in the manner described above to grasp the preceding end of the sheet member easily and securely. In this case, the preceding end of the sheet member is often out of its horizontal position. However, since the grasping device is connected to the movable base by means of a universal joint, the grasping device is automatically tilted to be parallel to the upper surface of the preceding end of the sheet member so that all the pawls abut against the sheet member substantially uniformly to ensure the grasping of the sheet member by the grasping device.

Thereafter, the movable base and the grasping units grasping the sheet member are transferred by means of the transfer means from a position above the pallet to a position above the conveyor. In this case, since the sheet member is grasped by the grasping units with the pawls bitten the sheet member, it is securely transferred to the position above the conveyor without disengaging from the pawls. After the preceding end of the sheet member is then urged against the conveyor by the urging roll, the sheet member is released from the grasping units. The guide roller is then moved from the proximity of the conveyor to a position immediately above the pallet by means of the moving means, while the guide roller is maintained in contact with the lower surface of the sheet member.

As a result, the sheet member extends from the pallet to the guide roller, bends at the guide roller and further extends to the conveyor. In this condition, the conveyor is actuated to draw the sheet member from the pallet. In this case, the sheet member is drawn substantially vertically upward from the pallet toward the guide roller, so that the sheet member is easily separated from its parts folded on itself, even if they closely stick one another. Therefore, the sheet member is supplied to the conveyor in a reliable manner.

In a preferred embodiment, the apparatus comprises rotating means for rotating the guide roller to drive the sheet member from the conveyor to the pallet, thereby returning the sheet member to the pallet. When the sheet member of a predetermined length has been drawn, the guide roller is rotated by the rotating means in the direction opposite to the direction in supplying the sheet member. With this simple construction, the sheet member can be easily returned from the conveyor to the pallet by means of the guide roller in this manner.

The invention will be more fully understood by referring to the following detailed specification and claims taken in connection with the appended drawings.

DESCRIPTION OF THE PREFERRED EMBODIMENTS

Figure 1:
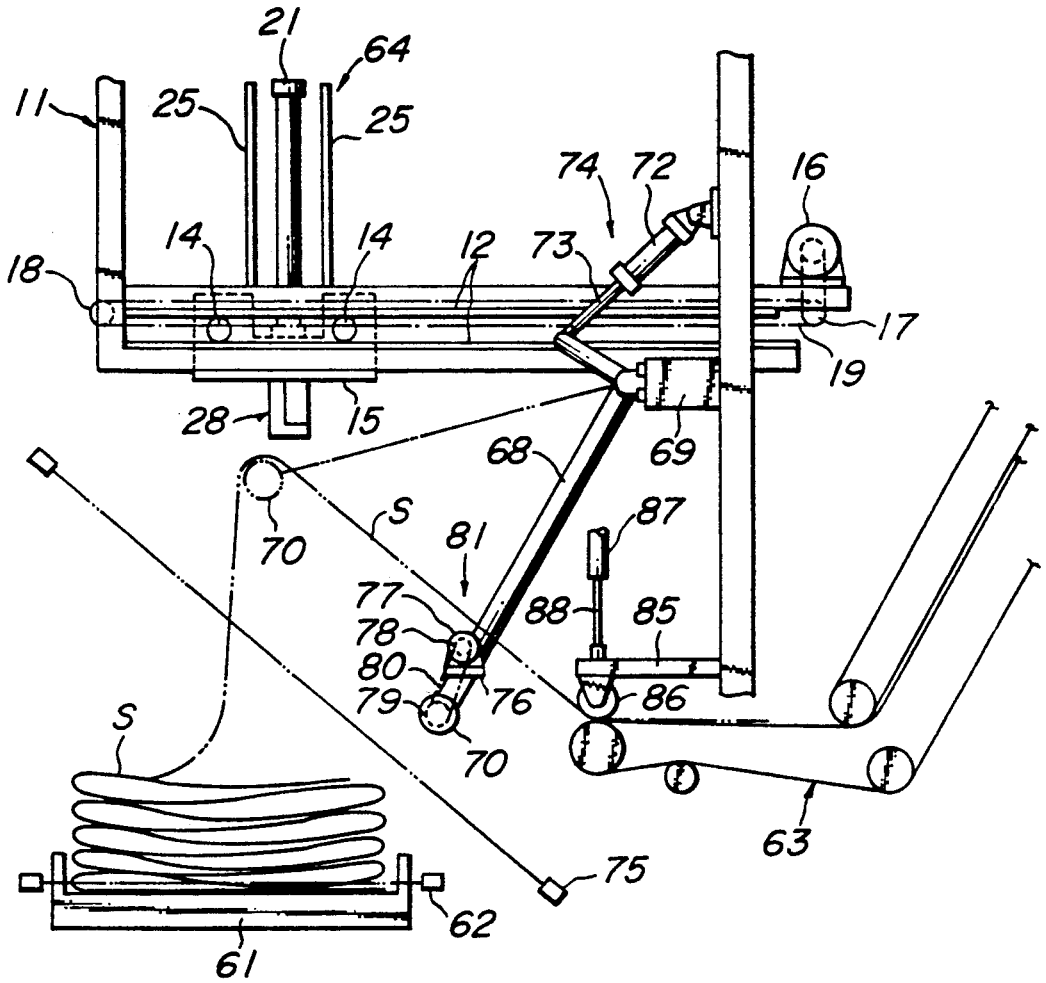
FIG. 1 is a schematic front view illustrating the device of one embodiment according to the invention.
Figure 2:
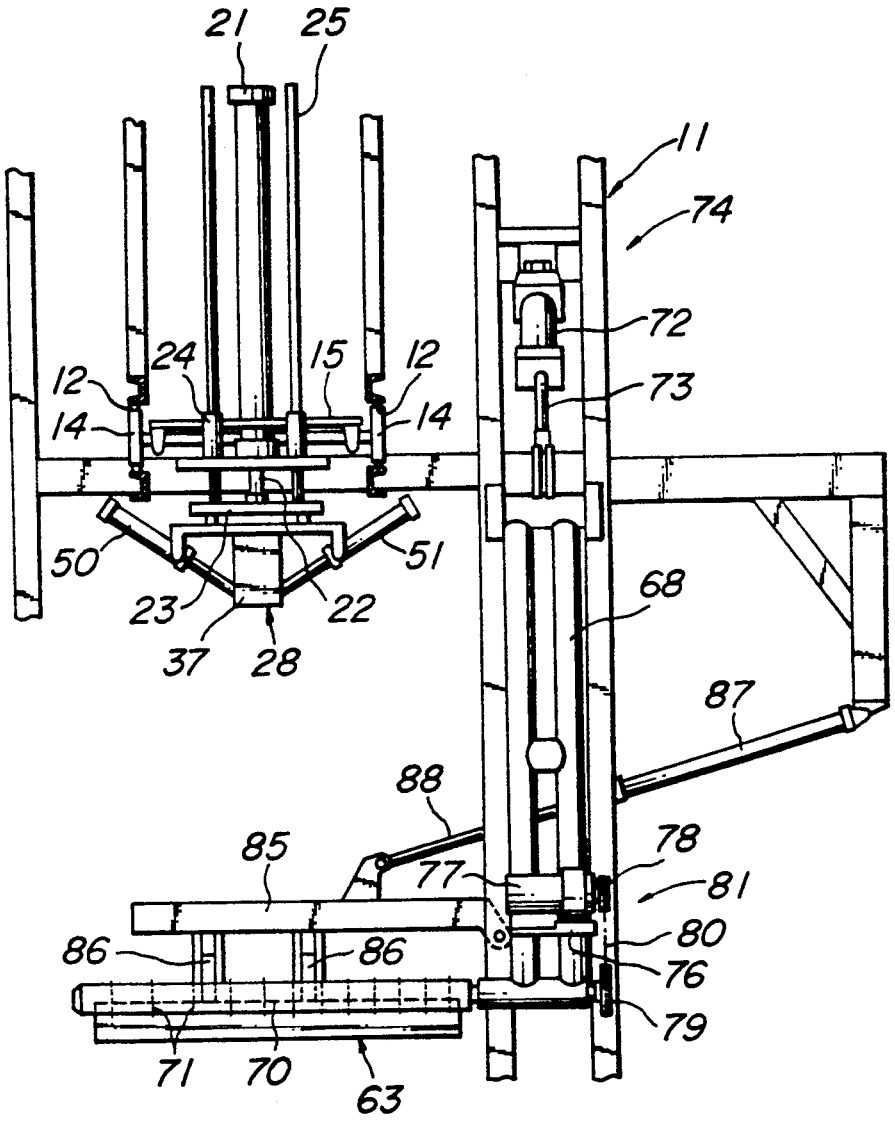
FIG. 2 is a schematic side view of the device shown in FIG. 1.

Referring to FIGS. 1 and 2, there is provided a frame 11 on which rails 12 are arranged to extend in the longitudinal direction which corresponds to the supplying direction or the longitudinal direction of a sheet member S later described. A movable frame 15 rotatably supports rollers 14 adapted to roll on the rails 12 so that the movable frame 15 is supported on the frame 11 and movable in the longitudinal directions. A motor 16 is arranged on the frame 11 at a position rearward of the movable frame 15. The rotation of the motor 16 is transmitted to a sprocket 17 rotatably supported on the frame 11 immediately below the motor 16. Another sprocket 18 is rotatably supported on the frame 11 forward of the movable frame 15, and a chain 19 is partially connected to the movable frame 15 and extends around the sprockets 17 and 18.

As a result, when the motor 16 is energized, the chain 19 is driven to move the movable frame 15 in the longitudinal directions. To the movable frame 15 is fixed a vertical cylinder 21 having a piston rod 22 whose outer end has a movable base 23 fixed thereto so that when the cylinder 21 is actuated to extend or retract its piston rod 22, the movable base 23 is vertically moved downwardly or upwardly. A plurality of guide members 24 are fixed to the movable frame 15, and vertical guide rods 25 are fixed with their lower ends to the movable base 23 and slidably inserted in the guide members 24.

Figure 3:
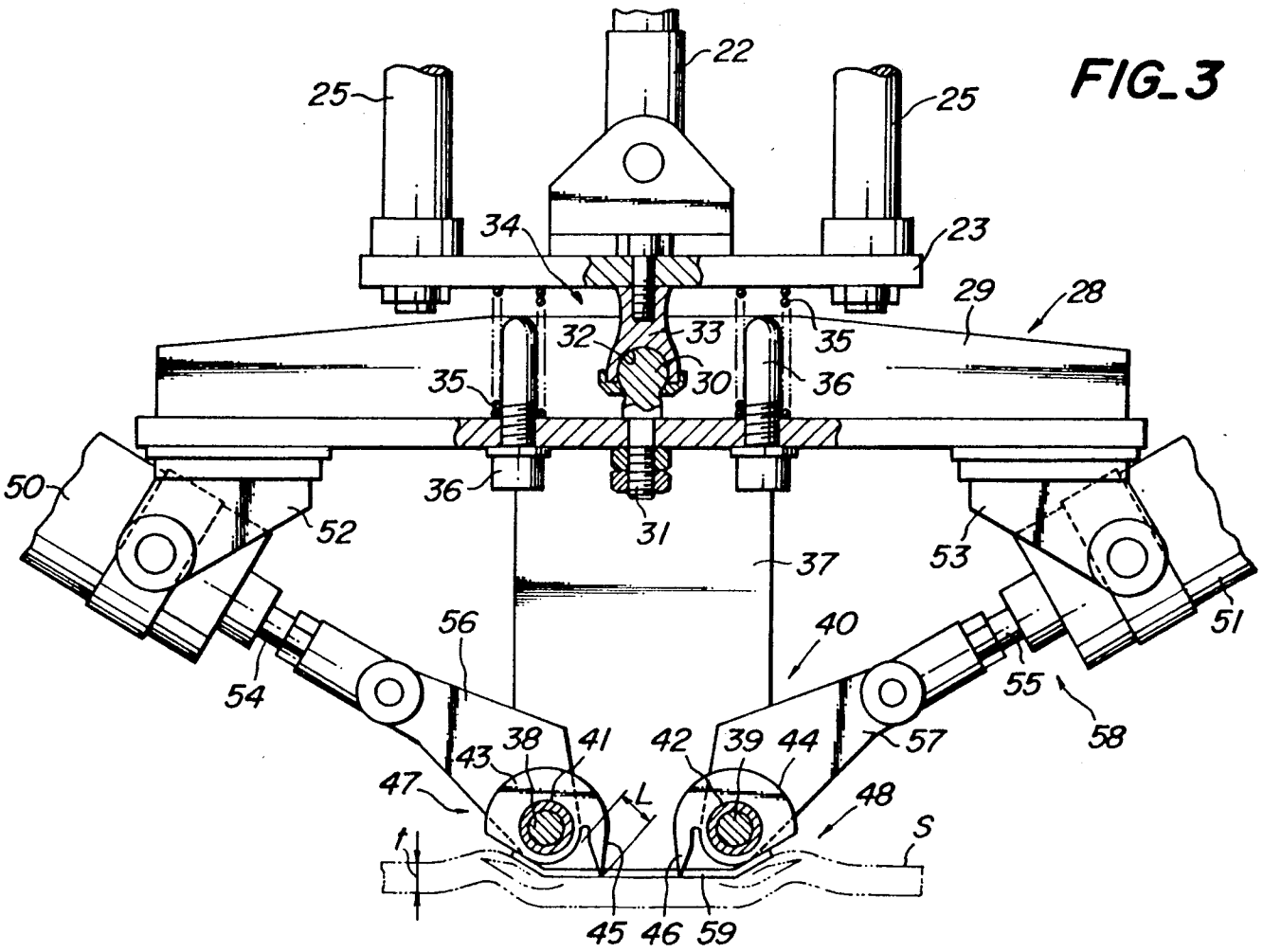
FIG. 3 is a partially removed side view of grasping units used in the device according to the invention.
Figure 4:
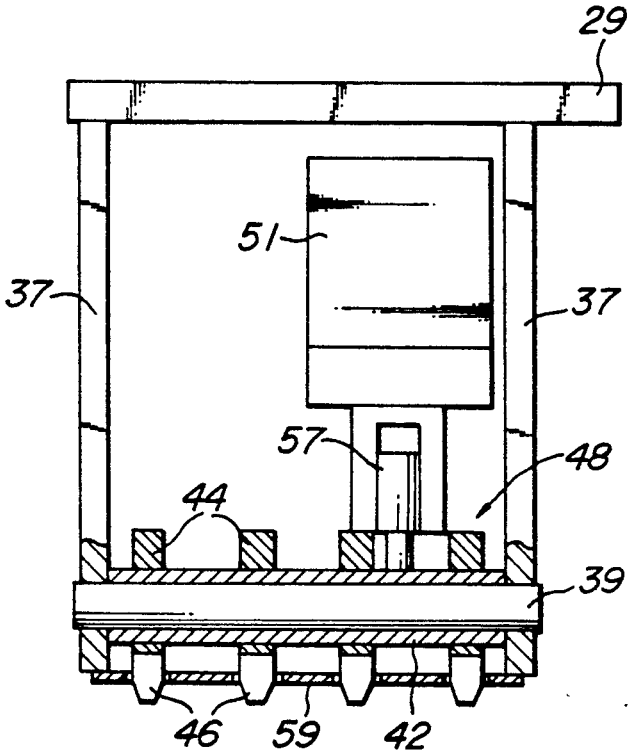
FIG. 4 is a partially removed front view of the grasping unit shown in FIG. 3.

Referring to FIGS. 2, 3 and 4, a grasping device 28 is provided immediately below the movable base 23 and has a support member 29 extending in the transverse directions. A joint 31 having a ball 30 is detachably secured to the support member 29 at its center, while a joint 33 formed with a spherical recess 32 is detachably secured to the movable base 23 positioned in opposition to the joint 31. The spherical recess 32 is adapted to close contact the ball 30 with a spherical surface. The joints 31 and 33 form as a whole a universal joint 34. As a result, the grasping device 28 is universally pivotally secured to the movable base 23 through the universal joint 34.

A plurality of springs 35 are interposed between the movable base 23 and the support member 29. If the grasping device 28 is tilted, the springs 35 serve to return the grasping device 28 to the horizontal position. These springs 35 are held at predetermined positions with the aid of regulating pins 36 secured to the support member 29. Mounting plates 37 are fixed to the support member 29 at its width ends, respectively. A pair of shafts 38 and 39 extending in the longitudinal direction are fixed with their ends to the lower ends of the mounting plates 37. The support member 29, the mounting plates 37 and the shafts 38 and 39 form as a whole support means 40.

Sleeves 41 and 42 are rotatably fitted on the shafts 38 and 39. Each of the sleeves 41 and 42 is provided with plural (four in the embodiment) grasping members 43 or 44 in the form of a sector and spaced equal distances in the axial direction of the shaft 38 or shaft 39 from one another. Each of the grasping members 43 and 44 is formed with a pawl 45 or 46 extending in a tangential direction to the sector and becomes thinner toward its distal end to form a sharp edge.

In the waiting position before the grasping operation, the pawls 45 and 46 are positions where they are closer together and extend downwardly as shown in FIG. 3. The radial distances L between the distal ends of the pawls 45 and 46 and the outer circumferences of the grasping members 43 and 44 are substantially equal to or less than the thickness t of a sheet member S, later described. The sleeves 41 and 42 and the grasping members 43 and 46 form as a whole a pair of grasping units 47 and 48 having the sharp pawls 45 and 46, respectively, which are supported by the support means 40 and rotatable in unison about the parallel shaft 38 and 39.

Cylinders 50 and 51 are pivotally connected through brackets 52 and 53 to the both ends of the support member 29 and have piston rods 54 and 55 whose outer ends have links 56 and 57 pivotally connected thereto, respectively. The other ends of the links 56 and 57 are secured to the sleeves 41 and 42, respectively. As a result, when the cylinders 50 and 51 are actuated to extend their piston rods 54 and 55, the grasping units 47 and 48 are rotated to move the pawls 45 and 46 away from each other, the former unit 47 in the clockwise direction and the latter unit 48 in the counterclockwise direction. Therefore, when the grasping units 47 and 48 are rotated with the pawls 45 and 46 abutting against the sheet member S, the pawls 45 and 46 bite the sheet member S to grasp it.

A horizontal deflector plate 59 is secured to the lower ends of the mounting plates 37 and formed with grooves permitting the grasping members 43 and 44 to pass therethrough. When the grasping units 47 and 48 grasping the sheet member S are rotated in the direction opposite to that described above, the deflector plate 59 abuts against the sheet member S to restrain movement of the sheet member S and assists in removal of the pawls 45 and 46 from the sheet member S. The cylinders 50 and 51 and the links 56 and 57 form as a whole pivotally rotating means 58 for rotating the grasping units 47 and 48 causing the pawls 45 and 46 to move away from each other. Moreover, the support means 40, the grasping units 47 and 48 and the pivotally rotating means 58 form as a whole the grasping device 28.

Referring back to FIGS. 1 and 2, immediately below the frame 11 is arranged a pallet 61 on which a continuous sheet member S such as a rubber sheet or the like which has thickness of 5 to 10 mm and is folded many times on itself. The pallet 61 is provided with a sensor 62 for detecting whether a sheet member S is arranged on the pallet 61. A conveyor 63 is arranged with its upstream end positioned immediately below the rearward end of the frame 11 and serves to transfer the sheet member S picked up from the pallet 61 toward the downstream side or the right side in FIG. 1. The rollers 14, the movable frame 15, the motor 16, sprockets 17 and 18, the chain 19 and the cylinder 21 form as a whole transfer mean 64 for transferring the movable base 23 and the grasping device 28 grasping the sheet member S from the pallet 61 to the conveyor 63.

An L-shaped arm 68 is rotatably supported with its bent portion on the frame 11 through a bracket 69. A horizontal guide roller 70 extends in the traverse direction or the width direction of the sheet member S and is supported by the lower end of the arm 68 so as to be able to contact the lower surface of the sheet member S drawn from the pallet 61. The guide roller 70 is freely rotated when the sheet member S moves from the pallet 61 to the conveyor 63. Moreover, the guide roller 70 is formed on its outer circumferential face with a great number of small projections 71 to prevent the sheet member S from slipping on the guide roller 70 with the aid of the increased friction between the sheet member S and the guide roller 70.

A cylinder 72 is pivotally connected to the frame 11 at a position above the bracket 69 and has a piston rod 73 whose outer end is connected to the upper end of the arm 68. When the guide roller 70 is in contact with the lower surface of the sheet member S, the piston rod 73 is retracted into the cylinder 72 to cause the arm 68 to rock so that the guide roller 70 is moved from the position shown in solid lines in FIG. 1 in the proximity of the conveyor 63 to a position shown in phantom lines directly above the pallet 61. The arm 68 and the cylinder 72 form as a whole moving means 74 for moving the guide roller 70 in contact with the lower surface of the sheet member S from the proximity of the conveyor 63 to the position directly above the pallet 61.

A sensor 75 is provided to detect the sheet member S drawn from the pallet 61 to the guide roller 70. A motor 77 is mounted on a bracket 76 provided on the lower end of the arm 68. A belt 80 extends around the pulley 78 fixed to an output shaft of the motor 77 and the pulley fixed to the guide roller 70. When the motor 77 is energized, the guide roller 70 is rotated in the direction to drive the sheet member S back onto the pallet 61. The motor 77, the pulleys 78 and 79 and the belt 80 form as a whole rotating means 81 for rotating the guide roller 70 to drive the sheet member S from the conveyor 63 toward the pallet 61.

A rocking arm 85 is pivotally supported at its bottom end by the frame 11, and when the rocking arm 85 has been pivotally rotated into the horizontal position, it becomes parallel to drams of the conveyor 63. Two urging rollers 86 are rotatably supported by the rocking arm 85 and serve to urge the preceding end of the sheet member S transferred by the grasping device 28 against the upstream end of the conveyor 63 when the rocking arm 85 is in the horizontal position. To the frame 11 is connected a cylinder 87 having a piston rod 88 whose outer end is connected to the rocking arm 85. When the cylinder 87 is actuated to extend the piston rod 88, the rocking arm 85 is rocked to the horizontal position.

The operation of the apparatus described above will now be explained.

In supplying a sheet member S on the pallet 61 to the conveyor 63 by the supplying apparatus, first the cylinder 21 is actuated to extend the piston rod 22, the movable base 23 and the grasping device 28 are lowered to positions immediately above the sheet member S arranged on the pallet 61. The downward movement of the movable base 23 and the grasping device 28 is stopped at the moment when the tips of the downwardly directing pawls 45 and 46 have just abutted against the upper surface of the sheet member S. In this state, the cylinders 50 and 51 are actuated to extend the piston rods 54 and 55, respectively, the grasping units 47 and 48 are rotated to move the pawls 45 and 46 away from each other.

During the movements of the pawls 45 and 46, the sharp edges of the pawls 45 and 46 are moved away from each other and biting the sheet member S so that the part of the sheet member S is pulled by these pawls 45 and 46 and hence subjected to a tensile force. In this case, the tensile force acts in the direction further forcing the pawls 45 and 46 into the sheet member S. Therefore, the pawls 45 and 46 further bite the sheet member S easily and securely. The grasping units 47 and 48 are stopped when they have rotated through 110° from their initial positions. At this time, the sharp edges of the pawls 45 and 46 are slightly raised upwardly as shown in phantom lines in FIG. 3 so that the sheet member S is securely grasped by means of the grasping units 47 and 48.

In grasping the sheet member S in this manner, its preceding end does not always extend in a horizontal direction. If it is not horizontal, the grasping device 28 will automatically tilt to be parallel to the upper surface of the preceding end of the sheet member S because the grasping device 28 is connected through the universal joint 34 to the movable base 23. Therefore, both pawls 45 and 46 uniformly abut against the sheet member S to assure the reliable grasping of the sheet member S by the grasping device 28. In this case, moreover, only the uppermost sheet member S or its preceding end is grasped by the grasping device 28, inasmuch as the distance L is less than the thickness t of the sheet member S.

Thereafter, the cylinder 21 is actuated to retract its piston rod 22 to raise the movable base 23 and the grasping device 28 grasping the sheet member S, and the motor 16 is then energized to move the movable frame 15, the movable base 23 and the grasping device 28 in unison toward the conveyor 63. The cylinder 21 is again actuated to extend its piston rod 22 to position the movable base 23 and the grasping device 28 immediately above the upstream end of the conveyor 63. As a result, the preceding end of the sheet member S grasped by the grasping device 28 has been transferred from the pallet 61 onto the conveyor 63. In this case, the sheet member S is held by the pawls 45 and 46 bitten in the sheet member S so that it is transferred onto the conveyor 63 in a reliable manner without any risk of dislodgement of the sheet member S from the grasping device 28.

At the moment of completion of this transfer, the cylinder 87 is actuated to extend its piston rod 88 to bring the rocking arm 85 toward the horizontal position. The rocking movement of the rocking arm 85 is stopped when the urging rollers 86 urge the preceding end of the sheet member S against the conveyor 63. Thereafter, the cylinder 50 and 51 are actuated to retract their piston rods 54 and 55 to rotate the grasping units 47 and 48 through 110° in the direction opposite to the rotating direction in grasping the preceding end of the sheet member S. As a result, the pawls 45 and 46 of the grasping units 47 and 48 are drawn from the sheet member S. At this moment, the sheet member S abuts against the deflector plate 59 so as to be restrained from its free movement so that the pawls 45 and 46 are surely drawn from the sheet member S. When the sheet member S has been released from the grasping device 28 in this manner, the preceding end of the sheet member S is arranged on the conveyor 63.

Thereafter, the cylinder 21 is actuated and the motor 16 is energized to return the grasping device 28 devoid of the sheet member S to its initial position. The cylinder 72 is then actuated to retract its piston rod 73 to rock the arm 68 upwardly. As a result, the guide roller 70 is brought into contact with the lower surface of the sheet member S, but the arm 68 is continuously rocked even after the contact of the guide roller 70. Consequently, the guide roller 70 moves from the proximity of the conveyor 63 to a position directly above the pallet 60, while the guide roller 70 contacting the lower surface of the sheet member S. As a result, the sheet member S of a certain length from its preceding end is progressively separated from the parts of the sheet member S remaining on the pallet 61 and once extends vertically upwardly from the pallet 61 toward guide roller and bends at the guide roller and further extends toward the conveyor 63.

When the conveyor 63 is actuated under this condition, the sheet member S is drawn from the pallet 61, turned at the guide roller 70 and rides on the conveyor 63 to a station for the next process. In this case, the sheet member S is substantially vertically raised from the pallet 61 to the guide roller 70. Therefore, even if the folded sheet member S has been closely sticked on itself many times, the preceding part of the sheet member S is easily separated from its remaining parts so that it is supplied onto the conveyor with a great certainty.

When the sheet member S of a predetermined length has been taken out of the pallet 61 and the supply operation has been completed, the sheet member S is cut on the conveyor by means of a cutter (not shown). Thereafter, the motor 77 is energized to rotate the guide roller 70 in the direction opposite to the direction in the supply process. As a result, the trailing portion of the sheet member S having a length of 6 to 7 m is returned by the guide roller 70 from the conveyor 63 onto the pallet 61 on which the returned sheet member is folded on itself. In this case, the great number of small projections 71 formed on the guide roller 70 increase the friction between the sheet member S and the guide roller 70 to prevent the sheet member S from slipping thereon so that the sheet member S is securely returned onto the pallet 61. The pallet 61 is then transferred out of the apparatus, and a pallet 61 having a sheet member S of a different kind arranged thereon is transferred under the frame 11. The operation thereafter is similar to that described above.

As can be seen from the above description, according to the invention a sheet member is securely grasped by the grasping device with the pawls easily biting the sheet member.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A device for grasping a sheet member for use in an apparatus for supplying the sheet member, said device comprising support means, a pair of grasping units having sharp pawls, respectively, and supported by the support means rotatably about parallel pivot axes, respectively, and pivotally rotating means for rotating the grasping units to move the pawls away from each other, wherein said support means comprises a support member, mounting plates fixed to and extending downwardly from the support member, a pair of shafts fixed to the lower ends of the mounting plates and extending in the longitudinal directions of the sheet member and spaced from each other in the width directions of the sheet member, said mounting plates are provided at their lower ends with a deflector plate secured thereto, said deflector plate is formed with grooves permitting the sharp pawls of the grasping members to pass therethrough, respectively, and able to abut against the sheet member to restrain any movement of the sheet member when the pawls of the grasping units grasping the sheet member are rotated in the direction opposite to the rotation in grasping the sheet member, thereby causing the sharp pawls to bite the sheet member such that the sheet member is securely grasped between the sharp pawls and opposite ends of the deflector plate.

2. The device for grasping a sheet member as set forth in claim 1, the grasping units are arranged such that each of sharp edges of the pawls is downwardly directed substantially perpendicular to the surface of the sheet member to be grasped at their initial biting position and raised upwardly at their final bitten position to grasp the sheet member between the pawls and opposite ends of the deflector plate.

3. The device for grasping a sheet member as set forth in claim 1, wherein each of said pair of grasping units comprises a sleeve rotatably fitted on the one of said pair of shafts of the support member, and plural grasping members in the form of a sector provided on the sleeve and spaced equal distances in the axial direction of the shaft from one another.

4. The device for grasping a sheet member as set forth in claim 3, wherein each of the grasping members is formed with the pawl extending in a tangential direction to the sector of the grasping member, the pawl becomes thinner toward its distal end to form a sharp edge.

5. The device for grasping a sheet member as set forth in claim 4, wherein when said pawls are in a waiting position before grasping the sheet member, said pawls are in positions where they are closer together and extend downwardly.

6. The device for grasping a sheet member as set forth in claim 4, wherein the radial distances between the distal ends of the pawls and the outer circumferences of the grasping members are not more than the thickness of the sheet member.

7. The device for grasping a sheet member as set forth in claim 1, wherein the pivotally rotating means comprises cylinders pivotally connected to the support member, and links whose ends are pivotally connected to the outer ends of piston rods of the cylinders and whose other ends are connected to the sleeves of the grasping units.

8. An apparatus for supplying a sheet member folded on itself on a pallet to a conveyor, comprising a movable base, a grasping device supported by the movable base through a universal joint for grasping the sheet member, transfer means for transferring the movable base and the grasping device grasping the sheet member from a position above the pallet to a position above the conveyor, a guide roller extending in the width direction of the sheet member and capable of contacting the lower surface of the sheet member, moving means for moving the guide roller contacting the lower surface of the sheet member from the proximity of the conveyor to a position directly above the pallet, and at least one urging roller for urging the sheet member transferred by the transfer means against the conveyor.

9. The apparatus for supplying a sheet member as set forth in claim 8, wherein said grasping device comprises support means, a pair of grasping units having sharp pawls, respectively, and supported by the support means rotatably about parallel pivot axes, respectively, and pivotally rotating means for rotating the grasping units to move the pawls away from each other, thereby grasping the sheet member by rotating the grasping units by the pivotally rotating means to cause the pawls to bite the sheet member.

10. The apparatus for supplying a sheet member as set forth in claim 9, wherein a plurality of springs are interposed between the movable base and a support member of the support means at both sides of the universal joint, respectively for returning the grasping device to an original position if it is shifted from the original position.

11. The apparatus for supplying a sheet member as set forth in claim 8, wherein said transfer means comprises a frame, a movable frame having rollers rolling on the frame, driving means for driving the movable frame on the frame, and vertically moving means for vertically moving the grasping device.

12. The apparatus for supplying a sheet member as set forth in claim 8, wherein said apparatus comprises rotating means for rotating said guide roller to drive the sheet member from the conveyor to the pallet, thereby returning the sheet member to the pallet.

13. The apparatus for supplying a sheet member as set forth in claim 8, wherein said guide roller is formed on its outer circumferential face with a number of small projections.

14. The apparatus for supplying a sheet member as set forth in claim 8, wherein said moving means comprises an L-shaped arm rotatably supported with its bent portion on a stationary portion of the apparatus and its lower end supporting said guide roller and a cylinder pivotally connected to the stationary portion and having a piston rod whose outer end is connected to the upper end of the L-shaped arm.

15. The apparatus for supplying a sheet member as set forth in claim 8, wherein said urging roller is rotatably supported by a rocking arm which is lockable by an actuation of a cylinder to bring the urging roller onto the conveyor.

* * * * *